US008574143B2

(12) United States Patent
Astheimer et al.

(10) Patent No.: US 8,574,143 B2
(45) Date of Patent: Nov. 5, 2013

(54) COMPLIANT DESIGN OF A HORIZONTAL SOLID-BOWL CENTRIFUGE WITH CLEANING-IN-PLACE NOZZLES

(75) Inventors: Achim Astheimer, Flörsheim-Weilbach (DE); Peter Kraemer, Eschborn (DE); Wolfgang Sittig, Hofheim (DE); Bernhard Unger, Niedernhausen (DE); Frank Zwilling, Mörfelden-Walldorf (DE)

(73) Assignee: Sanofi-Aventis Deutschland GmbH, Frankfurt am Main (DE)

( * ) Notice: Subject to any disclaimer, the term of this patent is extended or adjusted under 35 U.S.C. 154(b) by 0 days.

(21) Appl. No.: 11/857,852

(22) Filed: Sep. 19, 2007

(65) Prior Publication Data

US 2008/0053482 A1 Mar. 6, 2008

Related U.S. Application Data

(63) Continuation of application No. 11/468,056, filed on Aug. 29, 2006, now abandoned, which is a continuation of application No. 10/102,861, filed on Mar. 22, 2002, now abandoned.

(30) Foreign Application Priority Data

Mar. 23, 2001 (DE) ..... 101 14 598

(51) Int. Cl.
*B04B 15/06* (2006.01)

(52) U.S. Cl.
CPC ..... *B04B 15/06* (2013.01)
USPC ..... 494/26; 494/29; 494/41; 494/57; 494/60; 494/84

(58) Field of Classification Search
CPC ..... B04B 15/06
USPC ..... 494/26, 29, 41, 57, 60, 84, 25, 27, 56
See application file for complete search history.

(56) References Cited

U.S. PATENT DOCUMENTS 4,036,426 A 7/1977 Little
4,052,303 A * 10/1977 Hultsch et al. ..... 210/781

(Continued)

FOREIGN PATENT DOCUMENTS

EP 0443382 8/1991
JP 59032967 2/1984

(Continued)

OTHER PUBLICATIONS

English Translation of JP No. HEI 4[1992] 108548.*

(Continued)

*Primary Examiner* — Terry Cecil
(74) *Attorney, Agent, or Firm* — McDonnell Boehnen Hulberg & Berghoff LLP

(57) ABSTRACT

A horizontal solid-bowl centrifuge with cleaning-in-place jet nozzles for cleaning the bowl in a manner complying with good manufacturing procedure is provided. The bowl is cleaned by a defined arrangement of the cleaning jet nozzles, as the bowl rotates at a speed insufficient to produce a centrifugal force equal to gravitational acceleration, where gravitational acceleration is equal to 1.0 g. The cleaning liquids are then removed after the bowl stops rotating at the lowest point of the bowl.

20 Claims, 1 Drawing Sheet

(56) References Cited

U.S. PATENT DOCUMENTS

| | | | |
|---|---|---|---|
| 5,250,119 | A | 10/1993 | Poschl |
| 5,397,471 | A | 3/1995 | Rodebush et al. |
| 5,908,376 | A | 6/1999 | Macaluso et al. |
| 6,475,131 | B1 | 11/2002 | Yoshida et al. |

FOREIGN PATENT DOCUMENTS

| | | |
|---|---|---|
| JP | 04108548 | 4/1992 |
| JP | 04219156 | 8/1992 |

OTHER PUBLICATIONS rim. (2009). In Merriam-Webster Online Dictionary. Retrieved Feb. 18, 2009, from http://www.merriam-webster.com/dictionary/rim.*

English Translation of JP 59-032967, Feb. 1984.*

* cited by examiner

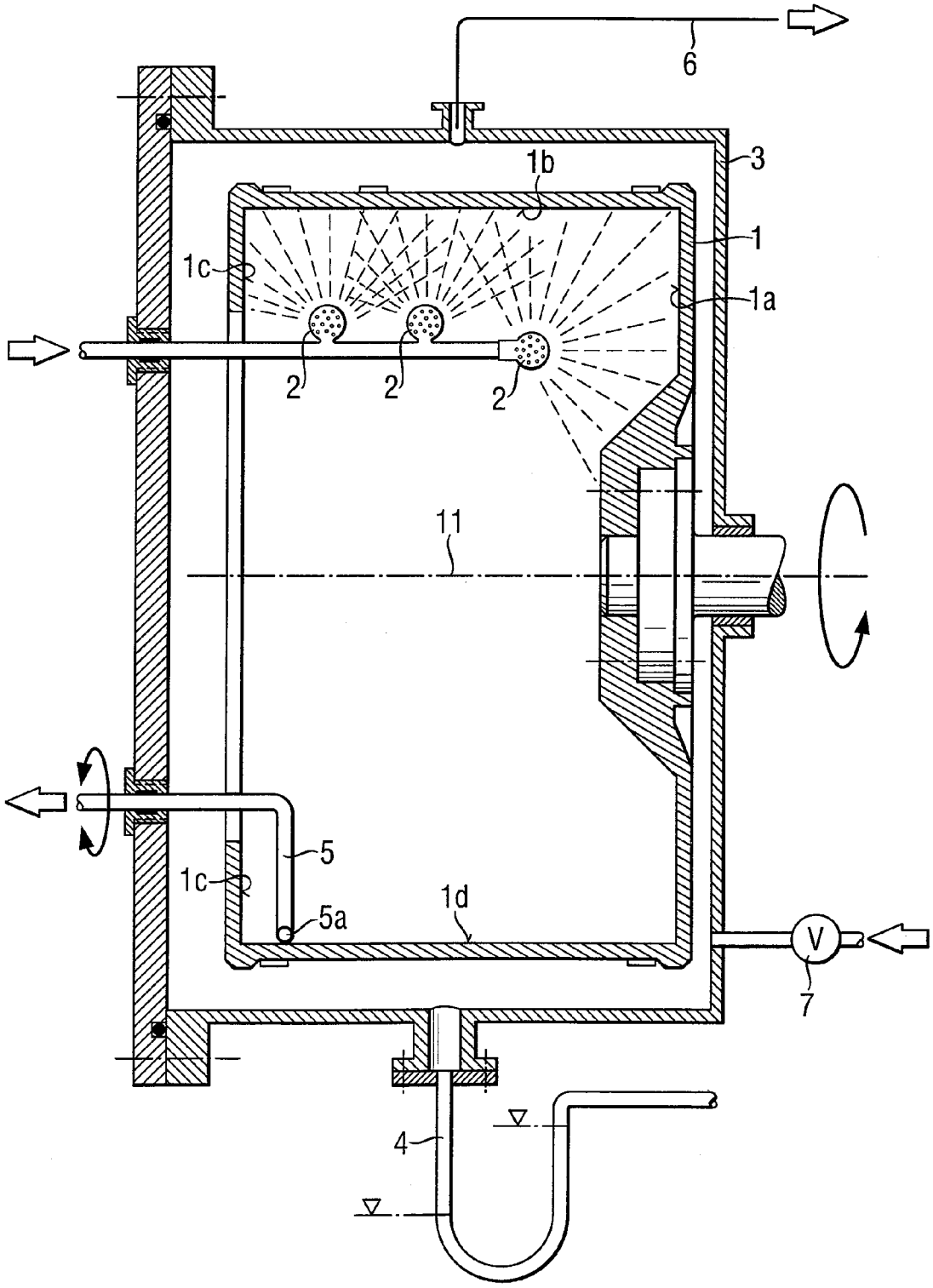
6
3
1b
1
1c
1a
2
2
2
11
5
1c
5a
1d
V
7
4

COMPLIANT DESIGN OF A HORIZONTAL SOLID-BOWL CENTRIFUGE WITH CLEANING-IN-PLACE NOZZLES

This application is a continuation of U.S. application Ser. No. 11/468,056, filed Aug. 29, 2006 now abandoned, which is a continuation of U.S. application Ser. No. 10/102,861, filed Mar. 22, 2002 now abandoned.

FIELD OF THE INVENTION

The invention relates to horizontal solid-bowl centrifuges with cleaning-in-place jet nozzles for cleaning the centrifuge in a manner complying with good manufacturing procedure.

BACKGROUND OF THE INVENTION

In a horizontal solid-bowl centrifuge, solid-liquid suspension enters the bowl through a duct. During use, the bowl is filled up to the rim and the bowl is rotated around an axis at full speed thus creating a gravitational field in the rotating solid-liquid suspension. The gravitational force causes the heavier solid parts of the suspension to settle against the walls of the bowl. During this settling operation, no rinsing liquid enters the bowl through the cleaning in place nozzles and the peeling tube is positioned such that it does not dip into the rotating solid-liquid suspension. After the settling operation is finished, a layer of solids will be lying next to the cylindrical wall of the bowl. Then the peeling tube will be positioned to allow an opening of the tube to dip into the liquid layer on top of the solid layer, and the liquid is peeled off to the outside of the bowl by the impact of the passing liquid as the bowl rotates. The peeling operation stops just before the solid layer would be touched. The solid layer then may be removed by peeling operation at lower speed by means of the same tube or by a special "knife" cutting the solid into a mechanical conveying device.

After the solid-liquid suspension has been separated and removed from the bowl, it is necessary to clean the bowl. Cleaning of the bowl is usually done by spraying a rinsing liquid onto the walls of the bowl while the bowl rotates. Subsequently, a final cleaning is performed manually while the centrifuge is stopped and the door is opened. If a filtering sieve drum is used, cleaning in place is possible without opening the centrifuge.

To be able to clean a horizontal solid-bowl centrifuge in a manner that complies with good manufacturing procedure, the rinsing solutions used in the individual cleaning steps must be removed from the interior without leaving any residue. However, the process described above and used with conventional centrifuges does not meet good manufacturing procedure standards because the rinsing solutions are not completely removed. A residual layer of cleaning solution remains on an inside wall of the bowl, even after peeling with the peeler tube.

SUMMARY OF THE INVENTION

In accordance with the invention, a solid-bowl centrifuge and a method for cleaning the solid-bowl centrifuge are provided.

According to one aspect of the present invention, a horizontal solid-bowl centrifuge is provided. The horizontal solid-bowl centrifuge comprises a rotatable drum, a plurality of cleaning-in-place jet nozzles inside the drum, the jet nozzles being configured to spray cleaning liquid onto an inner wall and a rear wall of the drum, and a tube for removing the cleaning liquid, the tube being positioned at the lowest point of the rotation of the drum.

According to another aspect of the present invention, a method of cleaning a horizontal solid-bowl centrifuge is provided. The method comprises providing cleaning-in-place nozzles within a drum of the centrifuge, rotating the drum at a speed insufficient to produce a centrifugal force equal to gravitational acceleration, where gravitational acceleration is equal to 1.0 g, spraying the interior of the drum with cleaning solution, and removing the cleaning solution from the drum at a portion of the drum at a lowest point in the rotation.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawing, which is incorporated in and constitutes a part of this specification, illustrates one embodiment of the invention and together with the description, serve to explain the principles of the invention.

BRIEF DESCRIPTION OF THE DRAWING

The single drawing FIGURE is a cross-sectional view of and embodiment of a horizontal solid-bowl centrifuge according to the present invention.

DESCRIPTION OF THE EMBODIMENT

Reference will now be made in detail to the present embodiment of the invention, an example of which is illustrated in the accompanying drawing. Wherever possible, the same reference numbers will be used throughout the drawing to refer to the same or like parts.

According to one aspect of the present invention, a horizontal solid-bowl centrifuge 1 is provided. As embodied herein and shown in the drawing, the centrifuge bowl or drum 1 includes cleaning in place jet nozzles 2. There may be between two and twelve cleaning jet nozzles present in the drum 1, and in a preferred embodiment, three cleaning jet nozzles 2 are provided. The jet nozzles 2 used for cleaning the inside of the bowl 1 are configured to direct their sprays onto the rear wall 1*a*, jacket (inside wall) 1*b*, and bowl rim 1*c*. As shown in the drawing, the cleaning in place jet nozzles 2 for cleaning the inside of the bowl are arranged to spray cleaning liquid mainly onto the inside wall 1*b* and rear wall 1*a* of the bowl 1 in an area of the upper ⅔ of the circle of rotation. The nozzle arrangement is defined by the necessity that all inside parts of the bowl and inner devices will be reached by the sprayed liquid. Jet nozzles installed for the purpose of cleaning a housing 3 and an outside of the bowl 1 are not shown in the drawing. In addition, details such as filler tube, level sensors, etc. are not shown. However, it is contemplated that conventional details, such as a filler tube or level sensors may be incorporated into the centrifuge of the present invention.

The centrifuge also includes a peeler tube 5. Peeler tube 5 is configured to move between an upward "disengaged" position and a downward, suctioning position within the bowl. Unlike peeler tubes in conventional centrifuges, the peeler tube 5 of the present invention is configured such that when in the downward, suctioning position, an inlet opening 5*a* of the peeler tube reaches the lowest part of the bowl where the liquid assembles when the centrifuge does not rotate.

In use, the solid-liquid suspension enters the bowl 1 through a duct (not shown) which ends above the wall 1*d* of the bowl (approximately 4 o'clock position). The bowl is filled up to the rim 1*c* of the bowl and the bowl is then rotated around horizontal axis 11 at full speed. Rotation around axis 11 creates a gravitational field in the rotating solid-liquid suspension. The gravitational force causes the heavier solid parts of the suspension to settle. During this settling operation no rinsing liquid enters the bowl 1 through cleaning in place jet nozzles 2. During this settling operation, the peeler tube 5 is positioned in the upward, disengaged position so that the opening 5*a* does not dip into the rotating solid-liquid suspension.

After the settling operation is finished a layer of solids will be lying next to the cylindrical wall of the bowl. Then the peeling tube 5 will slowly be turned thus causing the inlet opening 5*a* to dip into the liquid layer on top of the solid layer, and the liquid is then peeled off to the outside by the impact of the passing liquid. The peeling operation stops just before the solid layer would be touched. The solid layer then may be removed by peeling operation at lower speed by means of the same peeler tube 5.

After use, the bowl must be cleaned. Good manufacturing procedure regulations require total emptying of the cleaned system and a defined flow of gas in order to maintain an atmosphere of defined quality. In order to prevent an explosion whenever combustible solvents are part of the cleaning liquid, nitrogen instead of air is fed into the housing 3 through a gas delivery pipe 7, and the housing 3 is kept tightly sealed. A gas outlet 6 includes a pressure control which maintains a slight positive pressure head inside the housing 3. In this context, any other connection to the atmosphere outside the housing 3, such as a liquid drain 4, must ensure that no gas break-through can occur.

As previously discussed, good manufacturing procedure regulations require removal of the cleaning solution without leaving any residue. Effective cleaning of the bowl 1 includes emptying the installation to be cleaned as completely as possible of the successive cleaning media. For this purpose, at the end of each cleaning step the bowl 1 should expediently be shut down and the cleaning media which collect in the portion 1*d* of the bowl which is at it's lowest point of the rotation, i.e., used cleaning solution collected in the lower cross-sectional segment of the circle of rotation of the bowl 1, should be removed via the peeler tube 5.

As discussed above, removal of the cleaning liquid from the bowl occurs via peeler tube 5, which suctions the liquid at the lowest point of rotation of the bowl. The peeler tube 5 is connected to a suction fan or a suction pump (not shown). Alternatively, a suction tube or siphon tube may be used to remove the liquid. During emptying and operation, an inert gas is delivered to the housing 3 via an inert gas delivery system 7. Pressure maintenance ensures that explosion-suppressing conditions inside the centrifuge are maintained without interruption. The outflow 4 has a level controller which prevents the gas atmosphere from breaking through to the outside.

The cleaning solutions sprayed into the bowl 1 via the cleaning in place jet nozzles 2 provide the best cleaning action if they impact directly on the surfaces which are to be cleaned. The centrifuge as described in the present invention can be cleaned even without rotation, because it can be kept empty via tube 5. However, it is preferable to apply mild rotation, i.e., a rotation creating much less than 1× gravitational force/acceleration (1 g). It was found that, during cleaning, the bowl 1 should rotate at only a fraction of the speed of rotation at which a centrifugal force is equal to gravitational acceleration (g). As used herein, gravitational acceleration is represented by the letter "g," where g equals 9.81 $m/s^2$. The acceleration of the centrifuge bowl 1 should therefore be kept well below approximately 1.0 g. Each acceleration value for the centrifuge bowl which is greater than or equal to approximately 1.0 g will result in a stable film of liquid remaining on the bowl wall, which would screen off dirt from the action of the jet nozzles. Preferably, the acceleration value for the centrifuge bowl 1 will be between approximately 0 g and approximately 0.8 g. A most preferred value for the acceleration of the centrifuge bowl 1 is approximately 0.2 g.

According to one aspect of the present invention, the peeler tube 5 is in the downward suctioning position with the peeler tube inlet 5*a* arranged at the lowest point (6 o'clock position) in the centrifuge bowl 1. With peeler tube 5 being in the suctioning position, the cleaning or rinsing liquid enters bowl 1 through nozzles 2 while the bowl is rotating at very low speed. The used liquid then assembles at the bottom of the bowl and is sucked through peeler tube 5 to the outside. In order to remove any residual amounts of cleaning solutions, a vacuum is applied through the peeler tube 5 to suction the residual solutions from the inside of the centrifuge bowl 1. Preferably, the vacuum is strong enough to entrain the residual liquid as droplets.

If suctioning seems inappropriate, the used cleaning fluid can be pressed out of the bowl 1 by mild positive pressure of the gaseous atmosphere which can be applied through pipe 7. The centrifuge housing 3 must comprise suitably pressure-resistant and compact construction, for example, approximately 400 mbar, to permit removal of the residual liquid by delivering gas via the inert gas delivery system 7 instead of by suctioning. Generally, if the liquid is not sucked it cannot be removed as long as the pressure difference between the atmosphere inside chamber 3 and the atmosphere outside does not suffice to match the height between inlet opening 6a at the bottom of the bowl and an outlet of tube 5. In the case of inert gas overlay operation, the inert gas atmosphere must be maintained by supplying a correspondingly high level of nitrogen.

Regardless of whether the used cleaning fluid is removed via suction with the peeler tube or via the application of pressure to the bowl, the peeling tube 5 takes over the function of a liquid outlet tube. The liquid drain/siphon tube 4 allows the overflowing liquid and any spray gathering in the centrifugal chamber 3 to be removed without loss of a total positive pressure head.

The completeness of the emptying can be further assisted by the bowl having an internal diameter which increases toward the inlet of the peeler tube, thus causing any residual fluid to flow toward the bowl rim 1*c* and peeler tube inlet opening 5*a*.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. , A horizontal solid-bowl centrifuge comprising:

a stationary housing defining an interior configured to be tightly sealed to maintain a positive pressure when a gas is introduced into the interior through a gas delivery pipe in fluid communication with the interior of the housing;

a gas outlet and a liquid drain each in fluid communication with the interior of the housing and an exterior of the housing;

a rotatable drum positioned within the interior of the housing and configured to rotate about a horizontal axis of rotation relative to the housing, said drum including a rear wall, a bowl rim wall opposite said rear wall and a cylindrical inner wall extending therebetween, said bowl rim wall extending inwardly from said cylindrical inner wall toward said horizontal axis of rotation and defining an opening directly opposite said rear wall, said walls defining therebetween a bowl for receiving a solid-liquid suspension;

a plurality of cleaning-in-place jet nozzles positioned inside the drum, the plurality of jet nozzles being positioned offset from and above the horizontal axis of rotation, the plurality of jet nozzles being configured to spray cleaning liquid upwardly onto said rear wall, bowl rim wall and cylindrical inner wall of said drum, where the cleaning liquid is supplied to the jet nozzles through a pipe passing through an opening in the housing and where the opening is configured to maintain the positive pressure within the housing; and a tube extending through an opening in the housing, where the opening for the tube is configured to maintain the positive pressure within the housing and to allow rotation of the tube relative to the housing and within the drum, where the tube has an inlet opening positionable at a lowest point within the drum, the tube being adapted for removing the cleaning liquid and any solid layer formed from the solid-liquid suspension which has accumulated on the cylindrical inner wall.

2. The horizontal solid-bowl centrifuge of claim 1, wherein the drum is configured to rotate at a speed of rotation insufficient to create a centrifugal force equal to gravitational acceleration.

3. The horizontal solid-bowl centrifuge of claim 1, wherein the plurality of jet nozzles are positioned to spray the cleaning fluid in an area of the ⅔ of the circle of rotation of the drum.

4. The horizontal solid-bowl centrifuge of claim 1, wherein the tube is both a suction tube and a peeler tube, or a siphon tube and a peeler tube.

5. The horizontal solid-bowl centrifuge of claim 1, wherein the inlet opening of the tube is positioned at the lowest point within the rotatable drum.

6. The horizontal solid-bowl centrifuge of claim 1, wherein the tube is configured to remove the cleaning liquid and the solid layer while the drum is shut down.

7. The horizontal solid-bowl centrifuge of claim 1, wherein gravitational acceleration is equal to approximately 1.0 g and the speed of rotation of the drum is a speed sufficient to produce a centrifugal force between approximately 0.0 g and approximately 0.8 g.

8. The horizontal solid-bowl centrifuge of claim 7, wherein the speed is sufficient to produce a centrifugal force equal to approximately 0.2 g.

9. The horizontal solid-bowl centrifuge of claim 1, wherein the plurality of cleaning in place jet nozzles includes between two and twelve jet nozzles.

10. The horizontal solid-bowl centrifuge of claim 1, wherein the plurality of cleaning in place jet nozzles includes three jet nozzles.

11. The horizontal solid-bowl centrifuge of claim 1, wherein the tube for removing the cleaning fluid is a peeler tube, and wherein the peeler tube is configured to move between an upright, disengaged position and a downward suctioning position.

12. The horizontal solid-bowl centrifuge of claim 11, wherein an net opening of the peeler tube is positioned at the lowest point of the drum when the peeler tube is in the downward, suctioning position.

13. The horizontal solid-bowl centrifuge of claim 1, wherein the plurality of cleaning-in-place jet nozzles are stationary during rotation of the drum.

14. The horizontal solid-bowl centrifuge of claim 1, wherein the tube is configured to be positioned at the lowest point within the drum when the drum is stationary.

15. The horizontal solid-bowl centrifuge of claim 1, wherein the tube is configured to be positioned at the lowest point within the drum during rotation of the drum.

16. The horizontal solid-bowl centrifuge of claim 1, wherein the tube is configured to be stationary during rotation of the drum.

17. The horizontal solid-bowl centrifuge of claim 1, wherein the tube is positioned below the horizontal axis of rotation.

18. The horizontal solid-bowl centrifuge of claim 1, wherein said drum has an internal diameter that increases toward said inlet opening of said tube.

19. A horizontal solid-bowl centrifuge comprising:

a stationary housing defining an interior configured to be tightly sealed to maintain a positive pressure when a gas is introduced into the interior through a gas delivery pipe in fluid communication with the interior of the housing;

a gas outlet and a liquid drain each in fluid communication with the interior of the housing and an exterior of the housing;

a rotatable drum positioned within the interior of the housing and configured to rotate about a horizontal axis of rotation relative to the housing, said drum including a rear wall, a bowl rim wall opposite said rear wall and a cylindrical inner wall extending therebetween, said bowl rim wall extending inwardly from said cylindrical inner wall toward said horizontal axis of rotation and defining an opening directly opposite said rear wall;

a plurality of cleaning-in-place jet nozzles positioned inside the drum, the plurality of jet nozzles being positioned offset from and above the horizontal axis of rotation, the plurality of jet nozzles being configured to spray cleaning liquid upwardly onto said inner wall, said rear wall, and said bowl rim wall of said drum after a liquid layer and a solid layer have been removed from the drum, where the cleaning liquid is supplied to the jet nozzles through a pipe passing through an opening in the housing and where the opening is configured to maintain the positive pressure within the housing; and a tube adapted for removing the liquid layer and the solid layer from the drum, the tube extending through an opening in the housing, where the opening for the tube is configured to maintain the positive pressure within the housing and to allow rotation of the tube relative to the housing and within the rotatable drum, where the tube has an inlet opening positionable at a lowest point within the rotatable drum, wherein said tube is a peeler tube, and wherein said peeler tube is configured to move said inlet opening between a first position above said inner wall, for peeling off the liquid layer, and a second position in which said inlet opening is positioned at the lowest point within said rotatable drum, for removing the solid layer from said drum.

20. A horizontal solid-bowl centrifuge comprising:

a stationary housing defining an interior configured to be tightly sealed to maintain a positive pressure when a gas is introduced into the interior through a gas delivery pipe in fluid communication with the interior of the housing;

a gas outlet and a liquid drain each in fluid communication with the interior of the housing and an exterior of the housing;

a rotatable drum positioned within the interior of the housing and configured to rotate about a horizontal axis of rotation relative to the housing, said drum including a rear wall, a bowl rim wall opposite said rear wall and a cylindrical inner wall extending therebetween, said bowl rim wall extending inwardly from said cylindrical inner wall toward said horizontal axis of rotation and defining an opening directly opposite said rear wall, said walls defining therebetween a bowl for receiving a solid-liquid suspension;

a plurality of cleaning-in-place jet nozzles extending into the drum through the bowl rim wall, the plurality of jet nozzles being positioned offset from and above the horizontal axis of rotation and the plurality of jet nozzles being configured to spray cleaning liquid upwardly onto said rear wall, bowl rim wall and cylindrical inner wall of said drum, where the cleaning liquid is supplied to the jet nozzles through a pipe passing through an opening in the housing and where the opening is configured to maintain the positive pressure within the housing; and a tube for removing the cleaning liquid and a solid layer from the drum, the tube extending through an opening in the housing, where the opening for the tube is configured to maintain the positive pressure within the housing and to allow rotation of the tube relative to the housing and within the drum, the tube having an inlet opening positionable at a lowest point within the bowl, the tube being selected from the group consisting of a siphon tube and a suction tube.

* * * * *